US006627374B2

(12) United States Patent
Fumita et al.

(10) Patent No.: US 6,627,374 B2
(45) Date of Patent: Sep. 30, 2003

(54) PROCESS AND SYSTEM FOR PRODUCING TONER PARTICLES

(75) Inventors: Hidekazu Fumita, Sunto-gun (JP); Hitoshi Kanda, Yokohama (JP); Hiroshi Koyama, Yokohama (JP); Minoru Omura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/865,700

(22) Filed: May 29, 2001

(65) Prior Publication Data

US 2002/0031714 A1 Mar. 14, 2002

(30) Foreign Application Priority Data

May 31, 2000 (JP) ..... 2000-161363

(51) Int. Cl.[7] ..... G03G 9/08
(52) U.S. Cl. ..... 430/137.17; 430/137.1
(58) Field of Search ..... 430/137.17, 137.1; 422/131, 136, 137

(56) References Cited

U.S. PATENT DOCUMENTS

| | | | |
|---|---|---|---|
| 2,297,691 A | 10/1942 | Carlson | |
| 3,988,235 A | 10/1976 | Shibata et al. | 204/266 |
| 5,529,873 A | 6/1996 | Chiba et al. | |
| 5,916,726 A | 6/1999 | Kanda et al. | |
| 6,207,339 B1 | 3/2001 | Kata et al. | |

FOREIGN PATENT DOCUMENTS

| | | |
|---|---|---|
| EP | 0 982 635 | 3/2000 |
| JP | 36-10231 | 7/1961 |
| JP | 43-10799 | 5/1968 |
| JP | 51-14895 | 2/1976 |
| JP | 59-53856 | 3/1984 |
| JP | 59-61842 | 4/1984 |
| JP | 7-92736 | 4/1995 |
| JP | 8-160662 | 6/1996 |
| JP | 10-207122 | 8/1998 |

OTHER PUBLICATIONS

Database WPI, Section Ch, week 200040, Derwent Publs. XP–002176727 corresp. to JP 2000–143721A.

*Primary Examiner*—Janis L. Dote
(74) *Attorney, Agent, or Firm*—Fitzpatrick, Cella, Harper & Scinto

(57) ABSTRACT

A process for producing toner particles, comprising polymerizing in an aqueous dispersion medium a polymerizable monomer composition containing at least a polymerizable monomer and a colorant, to form colored polymer particles, followed by washing and then dehydration to obtain toner particles, and feeding the toner particles into an inside-evacuatable and heatable container to make vacuum heat treatment while introducing into the container an injection medium having a temperature lower than glass transition temperature Tg of the toner particles and selected from the group consisting of i) saturated steam, ii) superheated steam and iii) high-humidity air having an enthalpy of 2,500 kJ/kg (dry air) or higher. Also disclosed is a system which carries out the above process.

15 Claims, 4 Drawing Sheets

PROCESS AND SYSTEM FOR PRODUCING TONER PARTICLES

BACKGROUND OF THE INVENTION

1. Field of the Invention

This invention relates to a process for producing toner particles of toners used in processes of rendering latent images visible and in toner jet recording processes, and a system for producing such toner particles.

2. Related Background Art

A number of methods as disclosed in U.S. Pat. No. 2,297,691 and so forth are conventionally known as electrophotography. In general, copied images are obtained by forming an electrostatic latent image on a photosensitive member by utilizing a photoconductive material and by various means, subsequently developing the latent image by the use of a toner to form a toner image, and transferring the toner image to a transfer medium such as paper as occasion calls, followed by fixing by the action of heat, pressure or solvent vapor. As methods for developing electrostatic latent images by the use of toners or methods for fixing toner images, a variety of methods have been proposed, and methods suited for the corresponding image-forming processes are employed.

Toners used for such purpose have commonly been produced by melt-kneading colorants such as dyes and/or pigments into thermoplastic resins to effect uniform dispersion, followed by pulverization and classification to produce toners having the desired particle diameters.

Reasonably good toners can be produced by such a production method, but there is a certain limit, i.e., a limit to the range in which toner materials are selected. For example, resin-colorant dispersions must be brittle enough to be pulverizable by means of economically available production apparatus. However, resin-colorant dispersions made brittle in order to meet such a requirement tend to result in a broad particle size range of the particles formed when actually pulverized at a high speed, especially causing such a problem that fine particles tend to be included in the particles in a relatively large proportion. Moreover, such highly brittle materials tend to be further pulverized or powdered when used in development in, e.g., copying machines. Also, in this method, it is difficult to perfectly uniformly disperse solid fine particles of colorants and so forth in the resin, and, depending on the degree of their dispersion, toners may cause an increase in fog, a decrease in image density and a lowering of color mixing properties or transparency. Accordingly, care must be taken when they are dispersed. Also, colorants may come bare at rupture sections of toner particles, and may cause fluctuations in developing performance of toners.

Meanwhile, in order to overcome the problems of the toners produced by such pulverization, various polymerization toners and methods of producing such toners are proposed, including toners produced by suspension polymerization as disclosed in Japanese Patent Publications No. 36-10231, No. 43-10799 and No. 51-14895. For example, in the suspension polymerization, a polymerizable monomer, a colorant and a polymerization initiator, and also optionally a cross-linking agent, a charge control agent and other additives are uniformly dissolved or dispersed to form a monomer composition. Thereafter, this monomer composition is dispersed in a continuous phase, e.g., an aqueous medium, containing a dispersion stabilizer, by means of a suitable agitator, and is simultaneously subjected to polymerization to obtain toner particles having the desired particle diameters.

Since this method has no step of pulverization at all, the toner particles are not required to be brittle, and hence soft materials can be used. Also, since it is possible to omit the step of classification, this method is greatly effective for cost reduction on account of energy saving, reduction of production time, improvements in process yield and so forth.

Toner itself is also required to be made multifunctional because copying machines and printers are made to satisfy demands for high-image-quality, full-color and energy-saving in recent years. For example, in order to make toner particles with finer particle diameters so as to be adaptable to high-resolution digital systems corresponding to higher image quality, to improve the transparency of OHP images corresponding to full-color image formation and to make toners fixable at a lower energy saving temperature, toners are required to contain low-softening materials and to have toner particle shapes effective for improving transfer efficiency to transfer materials. As a means for meeting such requirements, the toners produced by polymerization are useful.

On the other hand, the polymerization causes an increase in viscosity of polymerization systems with progress of polymerization in its reaction form inclusive of that for polymerization toners, to make it difficult for radicals and polymerizable monomers to move, so that unreacted polymerizable monomer components tend to remain in a large quantity. Especially in the case of suspension polymerization toners, components having a possibility of inhibiting polymerization reaction as exemplified by dyes, pigments (in particular, carbon black), charge control agents and magnetic materials are present in polymerizable monomer systems in a large quantity in addition to the polymerizable monomers, and hence the unreacted polymerizable monomers much more tend to remain.

Then, where any components acting as solvents for binder resins without limitation to the polymerizable monomers are present in such toner particles, they may lower the fluidity of toner to make image quality poor and besides cause a lowering of anti-blocking properties. Besides performances which correlate directly as those of toners, especially when organic semiconductors are used as photosensitive members, problems caused by phenomena of deterioration of photosensitive members as exemplified by memory ghost and blurred images may occur in addition to a phenomenon of melt-adhesion of toner to photosensitive drums. In addition to such matters concerning the performances of products, there is such a problem that the polymerizable monomer components volatilize at the time of fixing to give off a bad smell.

To improve the matters stated above, it is proposed as disclosed in Japanese Patent Application Laid-open No. 7-92736 that any unreacted polymerizable monomers present in toner particles are reduced to a residue of 500 ppm or less to bring about the effect of more improving image quality.

In addition, as copying machines and printers are made compact and personal, restrictions are more placed on apparatus and a greater load is imposed on the above problems. Also, there is an increasing interest in environment, and it is demanded to reduce VOC (volatile organic compounds) arising from toner particles, generated at the time of, e.g., fixing. Accordingly, the unreacted polymerizable monomers present in toner particles may preferably be reduced to a residue of 100 ppm or less.

As methods by which the unreacted polymerizable monomers present in toner particles are reduced to a much smaller residue, any known means for accelerating the consumption of polymerizable monomers may be used which are used when binder resins are produced by polymerization. For example, methods of removing unreacted polymerizable monomers may include a method in which they are washed with a highly volatile organic solvent capable of dissolving toner binder resins but not dissolving polymerizable monomers and/or organic solvents; a method in which they are washed with an acid or an alkali; a method in which a solvent component which does not dissolve foaming agents and polymers is put into a polymer system and the resultant toner is made porous to enlarge the area where the inside polymerizable monomer and/or organic solvent components volatilize; and a method in which polymerizable monomer and/or organic solvent components are volatilized under dry conditions. Because it is difficult to select solvents, e.g., due to the point that toner constituents may dissolve out as a result of deterioration of toner encapsulation or the solvent may remain, most preferred is the method in which polymerizable monomer and/or organic solvent components are volatilized under dry conditions.

In conventional cases, from toner particles obtained after a suspension having completely undergone polymerization reaction has been solid-liquid separated, the volatile components are commonly removed by means of a flash dryer, a vacuum dryer or the like.

Where the volatile components are removed using the flash dryer alone, toner particles are dried while being dispersed in high-velocity hot-air streams and being simultaneously forwarded in parallel flow with respect to that streams, and wet colored polymer particles can continuously be fed into the high-velocity hot-air streams. Hence, the dryer is one having a very good efficiency. Since, however, the drying time is instantaneous, it has been difficult to remove unreacted polymerizable monomers.

As disclosed in Japanese Patent Application Laid-open No. 8-160662, a method is also proposed in which toner particles are vacuum-dried. This drying method has an advantage that the drying targets can be dried at a low temperature. However, since the inside of its system stands evacuated, the gaseous phase may stagnate to greatly lower the force of diffusing the volatile components. Hence, in order to remove water content by evaporation and thereafter remove unreacted polymerizable monomers, it takes a very long drying time.

As disclosed in Japanese Patent Application Laid-open No. 10-207122, a method is still also proposed in which toner particles are vacuum-dried while gas streams are injected. However, as disclosed in this publication, the use of inert gas such as nitrogen or air as a gas to be injected brings about an improvement in drying efficiency in view of the effect of carrier gas that is put forth to keep the volatile components from stagnating, compared with an instance where the gas merely effects vacuum drying, but, in the case of dry gas such as inert gas, the amount of heat the gas itself can have is so small that the gas may take heat off from the toner particles having been heated, resulting in a lowering of drying efficiency.

This prolongs drying time to make longer the heat history applied to the toner, to cause deformation of particles and mutual melt-adhesion of particles, so that powder lumps may occur to lower image characteristics.

Where the gas streams are not kept temperature-controlled by, e.g., heating, gas streams whose temperature has been lowered because of heat insulation and expansion in the course of gas feeding come to enter as they are, to more greately take heat off from toner particles, resulting in a more lowering of drying efficiency.

Moreover, in the case of the gas, any resistance due to diffusion which hinders evaporation (which, however, is less than the case when no carrier gas is used) is a main factor which determines the drying speed. Where, e.g., the gas flow rate is made higher in order to improve the drying speed, it is necessary to enhance the capacity of evacuation equipment (chiefly vacuum pumps), resulting in a very high production cost. This is more remarkable in a mass production scale.

As discussed above, this drying system leaves many problems in respect of efficiency, product quality and cost. Solution of such problems has been considered to be a subject imposed on many engineers.

SUMMARY OF THE INVENTION

An object of the present invention is to provide a process for producing toner particles and a production system therefor, having solved the problems discussed above.

More specifically, an object of the present invention is to provide a process for producing toner particles and a production system therefor by which volatile components present in toner particles obtained by polymerization can be removed uniformly and also in a short time.

Another object of the present invention is to provide a process, and a system, for producing toner particles which can form high quality images having no defects caused by any remaining volatile components.

Still another object of the present invention is to save energy and cost which are necessary to remove the volatile components.

The present invention provides a process for producing toner particles, comprising;

polymerizing in an aqueous dispersion medium a polymerizable monomer composition containing at least a polymerizable monomer and a colorant, to form colored polymer particles, followed by washing and then dehydration to obtain toner particles; and feeding the toner particles into an evacuatable and heatable container to carry out vacuum heat treatment while introducing into the container an injection medium having a temperature lower than glass transition temperature Tg of the toner particles and selected from the group consisting of i) saturated steam, ii) superheated steam and iii) high-humidity air having an enthalpy of 2,500 kJ/kg (dry air) or higher.

The present invention also provides a system for producing toner particles, which comprises an apparatus comprising;

a means for polymerizing in an aqueous dispersion medium a polymerizable monomer composition containing at least a polymerizable monomer and a colorant, to form colored polymer particles, followed by washing and then dehydration to obtain toner particles; and a means for feeding the toner particles into an evacuatable and heatable to carry out vacuum heat treatment while introducing into the container an injection medium selected from the group consisting of i) saturated steam, ii) superheated steam and iii) high-humidity air having an enthalpy of 2,500 kJ/kg (dry air) or higher;

the vacuum heat treatment being performed while detecting temperature A of the injection medium and controlling the temperature A so as to fulfill the following condition:

$$30^\circ\ C. < A < \text{glass transition temperature Tg of toner particles.}$$

DESCRIPTION OF THE PREFERRED EMBODIMENTS

Figure 1:
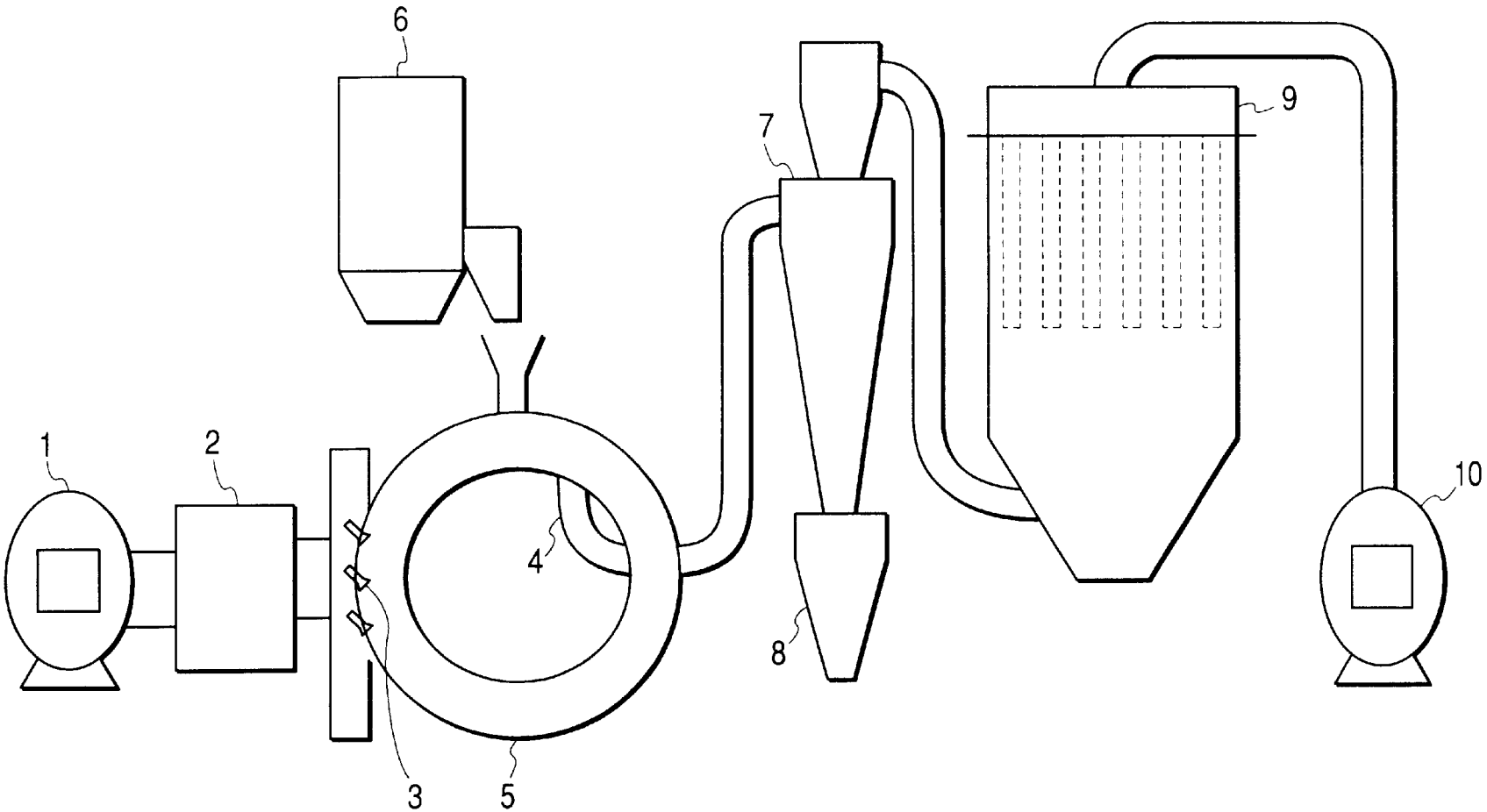
FIG. 1 is a schematic illustration of an example of a system of an apparatus in which toner particles are heat-treated while being dispersed in hot-air streams in a state of powdered particles and being forwarded in parallel flow with-respect to high-velocity air streams.

As a result of extensive studies, the present inventors have discovered that volatile components can be removed by feeding colored polymer particles into a container capable of evacuation and heating to carry out vacuum heat treatment while introducing into the container an injection medium which is any of i) saturated steam, ii) superheated steam and iii) high-humidity air having an enthalpy of 2,500 kJ/kg (dry air) or higher.

They have also discovered that the use of a heat treatment method in the present invention can reduce drive power to be applied during treatment, i.e., reduction of energy and cost.

The present inventors took note of two points that steam has a relatively small resistance due to diffusion which hinders the evaporation of volatile components present in toner particles and that it can have a larger amount of heat than a dry gas and is advantageous also in view of thermal efficiency. They have utilized these points to make it possible to remove volatile components (stated specifically, up to 100 ppm or less) from toner particles in a very short time.

Condensative gases such as steam (or high-humidity air containing steam in a large quantity) can be recovered as liquid by condensing the steam by means of a condenser. Accordingly, with regard to the amount of exhaustion made by an evacuation unit in order to form a vacuum (a state of reduced pressure), although the whole must be exhausted when the dry gas is used as carrier gas, only the portion having not been able to be recovered by means of the condenser may be exhausted when the steam is used.

Hence, the evacuation unit may have a small capacity, and this is greatly advantageous over the case when the dry gas is used, in view of energy and cost. In particular, the larger scale a heat treatment apparatus has, the greater the advantage is.

The flash dryer used in conventional processes for producing polymerization toners is a dryer having a very good efficiency, as stated previously. Since, however, the drying time is instantaneous, there has been such a problem that the trace-component unreacted polymerizable monomers can not be removed.

Where the volatile components are removed by means of a vacuum dryer, the gaseous phase may stagnate to greatly lower the force of diffusing the volatile components. Hence, there has been such a problem that, in order to remove water content by evaporation and thereafter remove unreacted polymerizable monomers, it takes a very long drying time.

As also stated previously, in the method in which toner particles are vacuum-dried while gas streams are injected (Japanese Patent Application Laid-open No. 10-207122), the gas such as inert gas having a small amount of heat in itself may take heat off from the toner particles having been heated, resulting in a lowering of drying efficiency. Where the gas is not kept temperature-controlled by, e.g., heating, gas streams whose temperature has been lowered because of heat insulation and expansion in the course of gas feeding come to enter as they are, as being apparent from the fact that as disclosed in Examples of the publication a great difference is produced between heating temperature and material temperature of toner particles. Thus, the heat is more greatly taken off from toner particles, resulting in a more lowering of drying efficiency. This has caused such a problem that the drying time is prolonged to make longer the heat history applied to the toner, to cause deformation of particles and mutual melt-adhesion of particles, so that powder lumps may occur to lower image characteristics.

Moreover, the above gas has caused such a problem that, since it is a non-condensative gas, the gas fed must be exhausted as it is in its entirety and the capacity of evacuation equipment (chiefly vacuum pumps) must be made very large, resulting in a very high production cost.

The present invention is described below in greater detail.

The injection medium used in the present invention is put under reduced pressure in the course of introduction into a container in which the vacuum heat treatment is made. Hence, stated strictly, at the point that it is introduced into a vacuum heat treatment apparatus, it is saturated steam, superheated steam or high-humidity air which has been put under reduced pressure up to an operating degree of vacuum (degree of vacuum inside the vacuum heat treatment container). Injection medium temperature so termed in the present specification also refers to the temperature of the injection medium put into this state.

The degree of vacuum that is useful in the present invention may preferably be 40 kPa, which is enough from the viewpoint of ensuring temperature difference $\Delta T$ in a large extent between the temperature of the injection medium to be introduced and the boiling point (i.e., saturation temperature) corresponding to the degree of vacuum, in order to prevent sweating (moisture condensation). More preferably, since the drying efficiency is improved with an increase in the degree of vacuum, it may be 20 kPa or below, still more preferably 15 kPa or below, and particularly preferably 10 kPa or below.

The "saturated steam" and "superheated steam" used in the present invention exists only as steam content. The "saturated steam" is steam substantially kept at saturated temperature corresponding to the operating degree of vacuum, and the "superheated steam" is steam overheated to saturated temperature or above. Also, the "high-humidity air" is chiefly occupied by steam content but may contain air (since air is used, here is termed "air", which, however, may be inert gas such as nitrogen). These are almost or entirely composed of steam content, compared with the dry air little containing steam content, commonly used as carrier gas, and hence, these retain a large amount of heat, have a high enthalpy, and are greatly different in the nature from the dry air.

The "enthalpy" of the high-humidity air, used in the present invention, refers to the sum of the quantity of heat for the sum of 1 kg of dry air per 1 kg of dry air and steam (kg) contained therein, and is expressed in units of "kJ/kg (dry air)".

The high-humidity air used in the present invention also has a very high enthalpy because it is almost occupied by steam, as being different from the gas little containing steam.

In the present invention, various methods are available as methods for enhancing the enthalpy of the high-humidity air, without any particular limitations.

"Feed flow rate" (or often "flow rate") of the injection medium used in the present invention refers to flow rate of the injection medium fed into the apparatus per unit time and per 1 kg of toner particles, and is expressed in units of "$m^3$/hr·kg (toner particles)".

The "water content" termed in the present invention refers to mass(weight)-based water content, i.e., proportion of mass of water to the total mass (the sum of mass of dried toner and mass of water), and is determined by measuring weight loss on heating at 105° C.

In the present invention, the injection medium may preferably have a temperature lower than glass transition temperature Tg of the toner particles.

The steam introduced comes into contact with the inside of the apparatus also at its portions having not been heated, whereupon it causes a temperature drop, and the temperature may drop to a boiling point (i.e., saturated temperature) corresponding to the degree of vacuum during operation to cause sweating (moisture condensation), resulting in a lowering of drying efficiency in some cases. In order to prevent it, the temperature difference ΔT between the temperature of the injection medium to be introduced and the boiling point (i.e., saturation temperature) corresponding to the degree of vacuum may preferably be set large (provided that, when the apparatus and toner particles are kept well heated and there is less possibility of causing the temperature drop, saturated steam corresponding to the degree of vacuum may be used). Where the steam has a low temperature, a fairly high vacuum is required in order to ensure the temperature difference ΔT, and this may impose a load on evacuation equipment. Accordingly, the steam may preferably have a temperature of 30° C. or above. Steam having temperature not lower than the glass transition temperature Tg of toner particles may also cause thermal deterioration of the toner particles, so that the problems of mutual melt-adhesion of particles and powder lumps may occur.

The high-humidity air used in the present invention may preferably be high-humidity air having an enthalpy of 2,500 kJ/kg (dry air) or higher, and preferably 6,500 kJ/kg (dry air) or higher. High-humidity air having an enthalpy lower than 2,500 kJ/kg (dry air) may have so small an amount of heat that it may take off heat from the toner particles having been heated, resulting in a lowering of drying efficiency. As the high-humidity air having such a high enthalpy, air having a water content of 50% or more may preferably be used because it can be easy to obtain high-humidity air having a high enthalpy, and more preferably air having a water content of 60% or more, and particularly preferably 80% or more.

The injection medium in the present invention may be fed at a flow rate of from 0.01 to 0.5 $m^3$/hr·kg (toner particles), and preferably from 0.04 to 0.27 $m^3$/hr·kg (toner particles). As long as it is within this range, the drying efficiency is basically improved with an increase in the feed flow rate of the injection medium. If the injection medium is fed at a flow rate lower than 0.01 $m^3$/hr·kg (toner particles), even an injection medium which can have a large amount of heat may feed a small amount of heat on the whole, resulting in a lowering of drying efficiency. If on the other hand the injection medium is fed at a flow rate higher than 0.5 $m^3$/hr·kg (toner particles), it becomes necessary to use the steam at a high flow rate, so that the degree of vacuum may be often lowered and hence the temperature difference ΔT between the saturated temperature corresponding to the operating degree of vacuum and the steam temperature may be so small as to present a high possibility of causing sweating (moisture condensation).

In the present invention, in order to cope with the restrictions on apparatus that must be placed as copying machines and printers are made more compact and personal and also to reduce VOC (volatile organic compounds) as stated previously, a trace amount of the polymerizable monomer composition which is considered present chiefly in the interiors of toner particles is also removed finally. When, however, the toner particles contain water in a large quantity, the water is present at particle surfaces, and hence the polymerizable monomer composition can not be reduced unless the water has been removed. Accordingly, in order to more improve the efficiency of removing volatile components, the water contained in the toner particles may preferably be removed in advance.

Stated specifically, the toner particles to be fed for the vacuum heat treatment may preferably be made to have a water content of 3.0% or less, and more preferably 1.0% or less. In the present invention, in order to make the toner particles have a water content of 3.0% or less, preliminary heat treatment may preferably be made before the vacuum heat treatment is carried out. As the preliminary heat treatment, for example, a method is available in which the toner particles are preliminarily heat-treated while being dispersed in high-velocity hot-air streams and simultaneously being forwarded in parallel flow with respect to that streams. More preferably, a heat treatment apparatus which can continuously feed toner particles into high-velocity hot-air streams may be used so that the toner particles is previously made to have a water content of 3.0% or less and the toner particles heated to certain temperature by such preliminary heat treatment are subjected to the vacuum heat treatment as they are maintained at that temperature.

Thus, both at the time of removal of water which requires a large amount of evaporation latent heat and at the time of material heating which requires a large amount of sensible heat, a step controlled by the amount of heat given from the heat conduction surface during the vacuum heat treatment is previously finished to bring the system into the state of a smaller difference between heating temperature and material temperature (the state of less heat flow). This not only can make treatment time shorter, but also can eliminate such a disadvantage that the proportion of heat conduction area to a sample charged into an apparatus typified by a vacuum heat treatment apparatus having heat conduction surface decreases with an increase in its scale, i.e., such a disadvantage that the drying time taken in a small-scale apparatus requires a much longer time in a large-scale apparatus. Hence, toner particles which may cause much less deterioration can be obtained.

In the present invention, when the vacuum heat treatment is started the toner particles may preferably have a material temperature of from 30 to 60° C.

If the toner particles have a material temperature lower than 30° C., much heat energy is required for the heating of toner particles at the time of vacuum heat treatment as stated above, and hence not only it takes a long treatment time but also, in a small-scale apparatus, the proportion of heat conduction area to the toner particles may be so small as to require a much longer treatment time. If on the other hand the toner particles have a material temperature higher than 60° C., mutual agglomeration and melt-adhesion of toner particles may occur, so that not only a problem on products may occur, but also the toner particles may melt-adhere to the interior of the vacuum heat treatment apparatus to take much labor and time for cleaning and so forth.

The apparatus for heat-treating toner particles instantaneously forwarding them in parallel flow with respect to high-velocity air streams, which is used as a preliminary heat treatment apparatus of the present invention, may include, but not particularly limited to, a heat treatment apparatus having a loop-type air-stream-heating tube 5 as shown in FIG. 1.

First, air fed from a jet blower 1 is heated to a stated temperature and compressed in a hot-air generator 2, and hot air is jetted from an air stream diffuser 3 at a very high velocity. A treating material fed from a material feeder 6 is dispersed by the air streams thus formed by jetting and is instantaneously treated (in 0.5 to few seconds) in the loop-type air-stream-heating tube 5. An air stream draw outlet 4 is provided on the inside of the loop-type air-stream-heating tube 5, whereby a group of particles standing agglomerated and a group of particles having been dispersed and standing close to single particles are classified by the Coanda effect. The particles thus classified are separated from the air streams by means of a cyclone 7 and are discharged from an unloading outlet 8. The air streams may be driven off outside the system from an exhaust blower 10, via a bag filter 9.

Coarse particles coming out of the loop-type air-stream-heating tube 5 may also separately be classified by means of a classifier and may be returned to the material feeder 6 so that only particles within a stated particle size may be fed to the cyclone 7 to obtain the desired toner particles, thus the classification and the heat treatment can also be made continuously.

In addition, the type of such an air stream heat treatment apparatus may be, besides the above loop type, a direct-tube type, a type in which an expanded middle barrel is provided in order to make residence time longer, and a type in which swirling motion is imparted to particles to prevent them from depositing on the bottom of a parallel tube. Thus, heat treatment tubes of various types may be used. Most preferred is the loop-type air-stream-heating tube 5 of the air stream heat treatment apparatus as shown in FIG. 1.

In the present invention, the heat treatment by hot-air streams may preferably be made using compressed air heated to form 40 to 150° C., and preferably from 60 to 120° C. If the heating temperature is lower than 40° C., a low drying efficiency may result, and if it is higher than 150° C., the melt-adhesion of toner may occur. Thus, such temperatures are not preferable.

The above apparatus may specifically include FLASH JET DRYER (manufactured by Seishin Kigyo K.K.) and FLASH DRYER (Hosokawa Mikuron K.K.).

A method of making vacuum heat treatment of the toner particles temperature-raised by the preliminary heat treatment, maintaining the temperature as it is, may include, but not particularly limited to, a method in which a hopper or the like having the function of heat insulation is provided between the step of preliminary heat treatment and the step of vacuum heat treatment.

The vacuum heat treatment apparatus used in the present invention may be any of apparatus which can effect evacuation and heat treatment and also into which the injection medium described above can be introduced, which may be used without any particular limitations. More preferred is an apparatus so systematized that the temperature of the injection medium can be detected and steam temperature A can be temperature-controlled to "30° C.<A< glass transition temperature Tg of toner particles".

Figure 2:
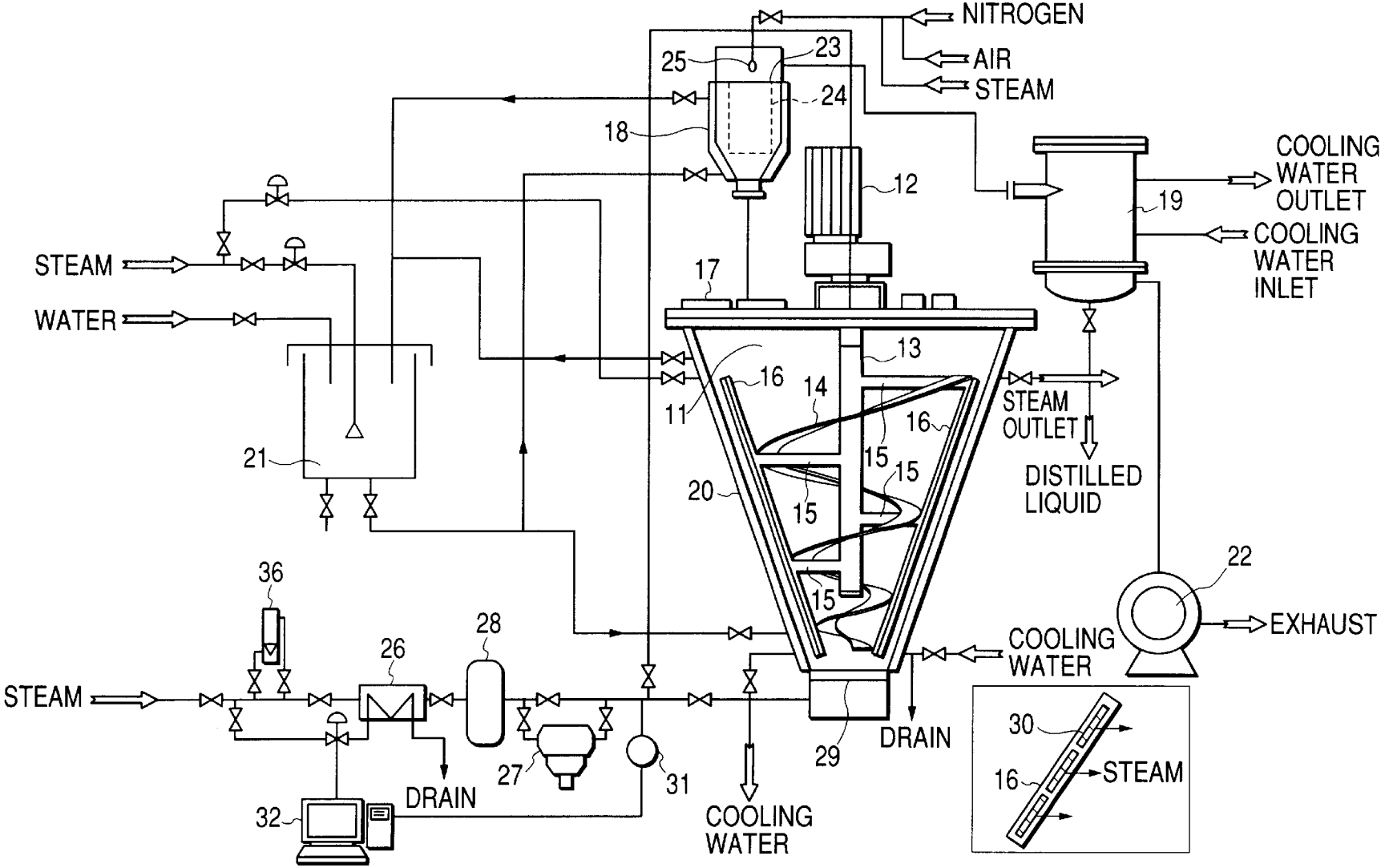
FIG. 2 is a schematic illustration of an example of a system for performing vacuum heat treatment while introducing an injection medium.
Figure 3:
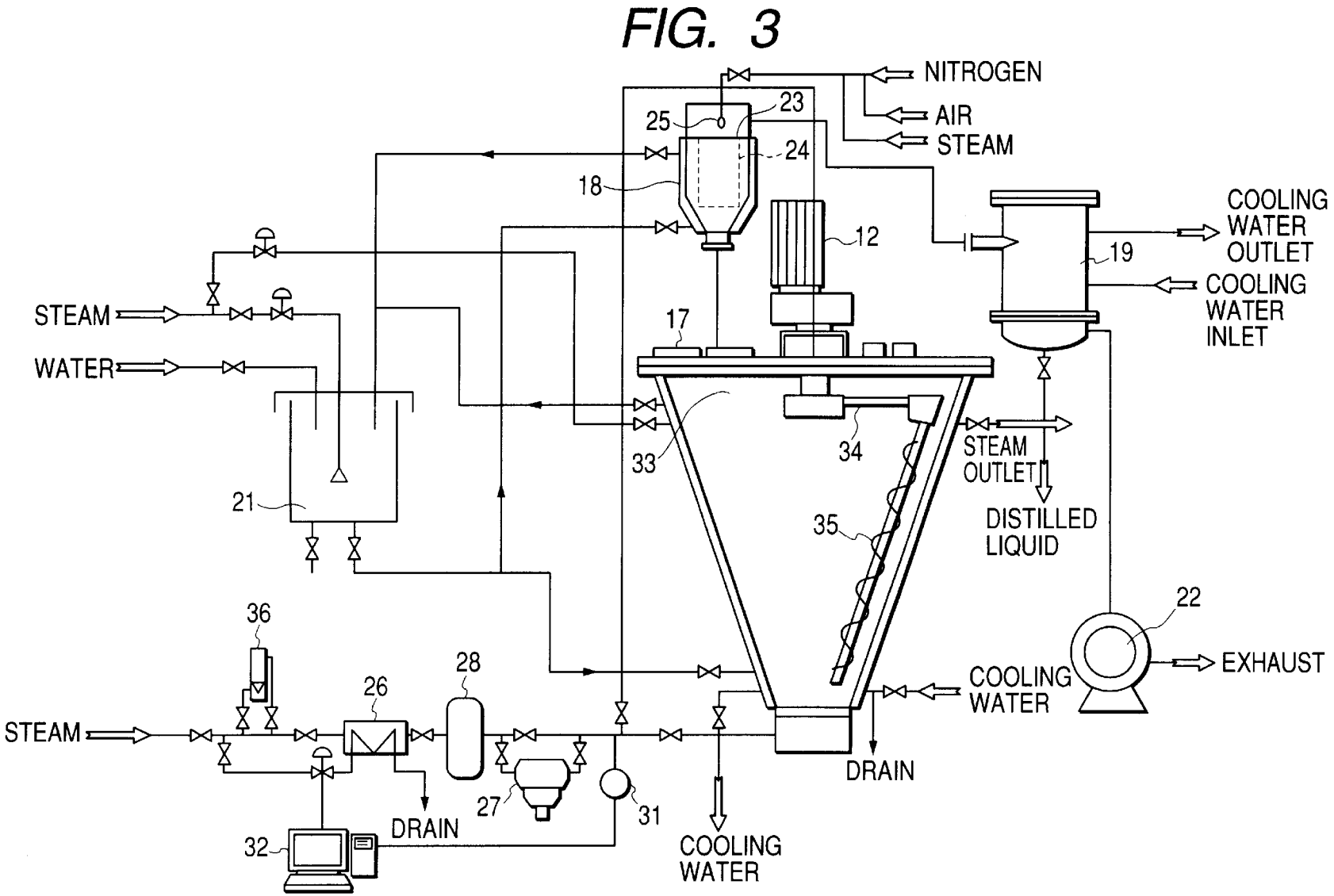
FIG. 3 is a schematic illustration of another example of a system for performing vacuum heat treatment while introducing an injection medium.
Figure 4:
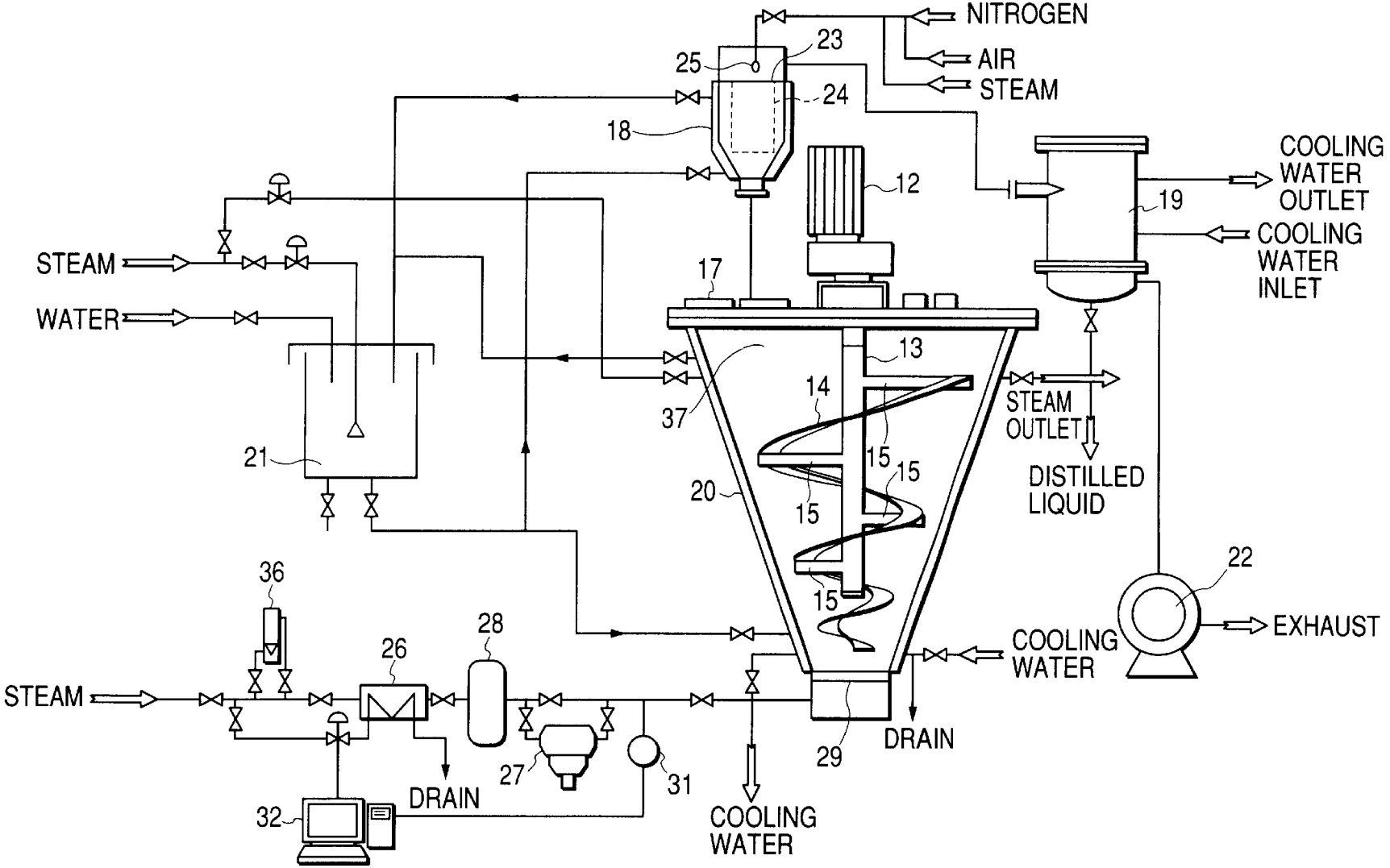
FIG. 4 is a schematic illustration of still another example of a system for performing vacuum heat treatment while introducing an injection medium.

For example, vacuum heat treatment systems embodied as shown in FIGS. 2 to 4 as diagrammatic side views may preferably be used.

The vacuum heat treatment systems embodied as shown in FIGS. 2 to 4 are described below in detail.

The vacuum heat treatment system shown in FIG. 2 is a system in which toner particles are fed into a reverse-conical vacuum heat treatment container 11 to effect vacuum heat treatment. In the container, an agitating center shaft 13 which can be driven by a drive motor 12 extends in the direction of a container center longitudinal axis, around which shaft a ribbon blade 14 having a single-spiral structure and on the outside of which connecting arms 16 supported with agitating-blade support arms 15 are provided along the container's wall surface. The container is constructed in this way.

As the ribbon blade 14 is rotated, the toner particles can repeatedly be agitated and dispersed while being lifted from the lower part to the upper part, and hence materials can be agitated and mixed in a good efficiency over the whole inside of the container. The connecting arms 16 will be described later.

As shown in FIG. 2, also connected to the upper part of the container 11 are a material feed opening 17 through which the toner particles are fed, a bag filter 18 provided in an exhaust line through which the inside of the container is evacuated, and then a condenser 19.

As shown in FIG. 2, further provided around the above vacuum heat treatment container is a jacket 20 for controlling the temperature inside the container appropriately so that the toner particles can be heat-treated at a desired temperature. Accordingly, a space is formed between the outer wall of the container and the inner wall of the jacket 20 so that heated steam or cooling water can be passed through this space, and hot water prepared in a hot-water tank 21, steam or cooling water can be fed to the jacket. At the same time, discharge lines for the hot water, steam and cooling water are also provided.

The inside of the container is evacuated by driving off the steam inside the container from an exhaust vent through the bag filter 18 and the condenser 19 by means of a vacuum pump 22. As shown in FIG. 2, the inside of the bag filter 18 is partitioned with a partition plate 23 into upper and lower two chambers. Then, a cylindrical filter cloth 24 is hung on the lower side of the partition plate 23, an exhaust line connected to the condenser 19 is provided on the upper side of the partition plate 23, and a back-wash nozzle 25 is provided at the center upper position of the filter cloth 24. The back-wash nozzle 25 is provided to intermittently spout nitrogen gas, air or the injection medium (preferably heated nitrogen gas, heated air or heated injection medium) to wash the filter cloth 24 by back pressure.

There are no particular limitations on a source of feeding the steam into the container. The steam is commonly often fed from a boiler steam generator, and it is passed through an injection medium flow meter 36 and heated with an injection medium heater 26 (if necessary, saturated water may be removed with a separator 27). Thereafter, the steam is put under reduced pressure approximately up to an operating degree of vacuum in an expansion tank 28. One part of the steam is uniformly fed into the apparatus from the bottom part of the apparatus via a dispersion table 29 through which the injection medium is uniformly dispersed. The other part is passed through a line the interior of which is entirely hollow and through which the interior of the agitating center shaft 13, then the interior of the agitating-blade support arms 15 and then the interior of the connecting arms 16 communicate with each other, where the steam, the injection medium, is sprayed against the wall surface from a plurality of injection medium jet holes 30 provided in the connecting arms 16. Thus, the toner particles can be prevented from adhering to the wall surface and the efficiency of heat conduction from the wall surface can be prevented from lowering. Hence, it is preferable to provide such connecting arms.

The temperature of the injection medium expanded in the expansion tank 28 is also detected with an injection medium thermometer 31 and is controlled by an injection medium temperature controller 32.

As the method of changing the injection medium into the state of reduced pressure, it is by no means limited to the above method. For example, in place of the installation of the expansion tank 28, the piping may be made to have a large diameter.

The injection medium is also jetted from the bottom part, whereby the toner particles can be prevented from causing blocking at the lower part of the apparatus. The injection medium is also jetted against the wall surface from the connecting arms 16, whereby the toner particles can be prevented from adhering to, and stagnating on, the wall surface and the particles near to the wall surface can (always) be renewed in a good efficiency. Hence, not only the heat conduction efficiency can be improved, but also the heat generated by agitation can simultaneously be prevented from being accumulated in the toner particles held in the container to cause excessive temperature rise (temperature rise to the heating temperature or above); the agitation heat being accumulated as a result of the interception of heat conduction that may otherwise be caused by adhesion or melt-adhesion of toner particles to the wall surface.

The injection medium fed into the vacuum heat treatment container is passed through the bag filter 18 in the form of steam mixed with volatile components arising from the toner particles, and is condensed and collected in the next condenser 19. Any steam having not been able to be collected is discharged outside the system through a vacuum pump 22. In the state where the water of the toner particles has substantially been removed, the volatile components arising from the toner particles are in such a trace quantity that almost all volatile components can be controlled by the injection medium having been fed. As a result, the above injection medium, which is condensative, is collected in the condenser 19 as water in its greater part, and hence the vacuum pump 22 can be in a small capacity.

A vacuum heat treatment apparatus 37 shown in FIG. 4 is so constructed that the connecting arms shown in FIG. 2 are not provided and only the ribbon blade having a single-spiral structure is provided. For the portion of the connecting arms which have been detached, the ribbon blade has a larger diameter, having a smaller distance between the wall surface and the ribbon blade. Hence, the effect of lifting toner particles near to the wall surface from the lower part to the upper part is greater. Construction of the other parts of the vacuum heat treatment system shown in FIG. 4 is common to that of the vacuum heat treatment system shown in FIG. 2 except that the steam is fed only from the bottom of the apparatus. Accordingly, description on those parts is omitted.

Meanwhile, a vacuum heat treatment apparatus 33 shown in FIG. 3 is provided with a screw-type agitation member 35 connected via a drive arm 34 to a drive motor 12 disposed above a reverse-conical container, and is so constructed that the agitation member is turned being rotated, along the inner periphery of the container. Thus, in the vacuum heat treatment apparatus shown in FIG. 3, the toner particles in the container are repeatedly agitated and dispersed while being lifted from the lower part to the upper part, and hence the toner particles in the container can be agitated and mixed in a good efficiency over the whole inside of the container. Construction of the other parts of the vacuum heat treatment system shown in FIG. 3 is common to that of the vacuum heat treatment system shown in FIG. 2 except that the steam is fed only from the bottom of the apparatus. Accordingly, description on those parts is omitted.

The vacuum heat treatment apparatus to which the production process of the present invention is applicable may specifically include, in addition to the apparatus embodied as shown in FIGS. 2 and 3, apparatus such as NAUTA Mixer (manufactured by Hosokawa Mikuron K.K.) RIBOCONE Mixer (manufactured by Ohkawara Seisakuysho K.K.), PV Mixer (manufactured by Shinko Pantec co.), a vacuum agitation dryer INOX System (manufactured by Pawrex Co.) And SV Mixer (manufactured by Shinko Pantec Co.).

The toner particles according to the present invention, may preferably be toner particles having fine particle diameter in order reproduce finer latent-image dots faithfully, because of a demand for higher image quality. Stated specifically, toner particles having a weight-average particle diameter of from 4 to 10 $\mu$m and a number-average variation coefficient of 35% or less, as measured with COULTER Counter (manufactured by Coulter Co.), are particularly preferred.

Toner particles having a weight-average particle diameter smaller than 4 $\mu$m are not preferable because transfer residual toner may greatly occur on photosensitive members or intermediate transfer members because of a poor transfer efficiency. Toner particles having a weight-average particle diameter larger than 10 $\mu$m are also not preferable because the melt-adhesion of toner to constituent members tends to occur, and such a tendency is more intensified if the toner particles have a number-average variation coefficient more than 35%.

Referring to methods for producing the toner particles of the present invention, the toner particles may be produced by using a method in which toner particles are directly formed by suspension polymerization or emulsion polymerization as disclosed in Japanese Patent Publications No. 36-10231 and Japanese Patent Applications Laid-open No. 59-53856 and No. 59-61842.

In the present invention, what is called seed polymerization may also preferably be used in which a monomer is further adsorbed on polymerization particles once obtained and thereafter a polymerization initiator is used to carry out polymerization.

The polymerizable monomer usable in the present invention may include styrene monomers such as styrene, o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and butadiene, isoprene, cyclohexene, acrylo- or methacrylonitrile, and vinyl monomers such as acrylic acid amide. Any of these may optionally be used in a combination of two or more types.

In the present invention, in order to wrap a low-softening substance up in a shell resin obtained by polymerizing the polymerizable monomer as described above, it is particularly preferable to further add a polar resin as an additional shell resin. As the polar resin used in the present invention, preferred are copolymers of styrene with acrylic or methacrylic acid, maleic acid copolymers, saturated or unsaturated polyester resins, and epoxy resins. The polar resin may particularly preferably be those not containing in the molecule any unsaturated groups that may react with the shell resin or the polymerizable monomer. If a polar resin having such unsaturated groups is contained, cross-linking reaction with the polymerizable monomer that forms the shell resin layer takes place, so that the shell resin comes to have a too high molecular weight for the toners for forming full-color images and is disadvantageous for color mixture in the case of full-color toners making use of four color toners, a black toner, a magenta toner, a cyan toner and a yellow toner. Thus, such a resin is not preferable.

As the low-softening substance, it is preferable to use a compound showing an endothermic maximum peak value at the temperature of from 40 to 90° C. as measured by DSC (differential scanning calorimetry) according to ASTM D3418-8. If the maximum peak is at a temperature lower than 40° C., the low-softening substance may have a weak self-cohesive force, resulting in weak high-temperature anti-offset properties. This is undesirable for full-color toners. If on the other hand the maximum peak is at a temperature higher than 90° C., a high fixing temperature may result, making it difficult to smoothen fixed-image surfaces appropriately. This is undesirable in view of color mixing performance. Moreover, when the toner particles are directly obtained by polymerization, the granulation and polymerization are effected in an aqueous medium, and hence, if the endothermic peak value is at a high temperature, the low-softening substance may precipitate mostly during granulation in the aqueous medium to undesirably hinder the reaction system of suspension polymerization. Stated specifically, usable as the low-softening substance are paraffin waxes, polyolefin waxes, Fischer-Tropsch waxes, amide waxes, higher fatty acids, ester waxes, and derivatives of these or grafted or blocked compounds of these.

As the colorant used in the present invention, carbon black, magnetic materials, and colorants toned in black by the use of yellow, magenta and cyan colorants shown below may be used as black colorants.

As a yellow colorant, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147, 168 are preferably used.

As a magenta colorant, condensation azo compounds, diketopyrolopyyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are preferably used.

As a cyan colorant, copper phthalocyanine compounds and derivatives thereof, anthraquinone compounds and basic dye lake compounds may be used. Stated specifically, C.I. Pigment Blue 1, 7, 15:1, 15:2, 15:3, 15:4, 60, 62, 66 may preferably be used.

Any of these colorants may be used alone, in the form of a mixture, or in the state of a solid solution. The colorants used in the present invention are selected taking account of hue angle, chroma, brightness, environmental stability, transparency on OHP films and dispersibility in toner particles. The colorant may preferably be used in an an amount of from 1 to 20 parts by weight based on 100 parts by weight of the binder resin. When a magnetic material is used as the black colorant, it may be used in an amount of from 40 to 150 parts by weight based on 100 parts by weight of the binder resin, which is different from the amount of other colorants.

As a charge control agent which may be used in the present invention, known agents may be used. It is preferable to use charge control agents that are colorless, make toner charging speed higher and are capable of stably maintaining a constant charge quantity. When the toner particles are directly obtained by polymerization in the present invention, charge control agents having no polymerization inhibitory action and being insoluble in the aqueous system are particularly preferred. Specific compounds may include, as negative charge control agents, metal compounds of salicylic acid, naphthoic acid or dicarboxylic acids, polymer type compounds having sulfonic acid or carboxylic acid in the side chain, boron compounds, urea compounds, silicon compounds and carixarene. As positive charge control agents, they may include quaternary ammonium salts, polymer type compounds having such a quaternary ammonium salt in the side chain, guanidine compounds, and imidazole compounds. Any of these charge control agent may preferably be used in a amount of from 0.5 to 10 parts by weight based on 100 parts by weight of the binder resin. In the present invention, however, the addition of the charge control agent is not essential. When two-component development is employed, the triboelectric charging with a carrier may be utilized, and also when non-magnetic one-component blade coating development is employed, the triboelectric charging with a blade member or sleeve member may be utilized. In either case, the charge control agent need not necessarily be contained in the toner particles.

Polymerization initiators usable in the polymerization toner according to the present invention may include, e.g., azo- or diazo-type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide-type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. The polymerization initiator may usually be added in an amount of from 0.5 to 20% by weight based on the weight of the polymerizable monomer, which varies depending on the intended degree of polymerization. The polymerization initiator may a little vary in type depending on the methods for polymerization, and may be used alone or in the form of a mixture, with reference to its 10-hour half-life period temperature.

In order to control the degree of polymerization, any known cross-linking agent, chain transfer agent and polymerization inhibitor may further be added.

In the polymerization toner according to the present invention, especially when suspension polymerization making use of a dispersant is used, the dispersant to be used may include, e.g., as inorganic oxides, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. Organic compounds may include polyvinyl alcohol, gelatin, methyl cellulose, methyl hydroxypropyl cellulose, ethyl cellulose, carboxymethyl cellulose sodium salt, polyacrylic acid and salts thereof, and starch, which may be used by dispersing them in aqueous phases. Any of the stabilizers may preferably be used in an amount of from 0.2 to 20 parts by weight based on 100 parts by weight of the polymerizable monomer.

Of these dispersants, when the inorganic compound is sued, those commercially available may be used as they are. In order to obtain fine particles, however, the inorganic compound may be formed in the dispersion medium. For example, in the case of tricalcium phosphate, an aqueous sodium phosphate solution and an aqueous calcium chloride solution may be mixed under high-speed agitation.

In order to finely disperse these dispersants 0.001 to 0.1% by weight of a surface-active agent may be used in combination. This is to accelerate the intended action of the dispersion stabilizer. As specific examples, it may include sodium dodecylbenzenesulfonate, sodium tetradecyl sulfate, sodium pentadecyl sulfate, sodium octyl sulfate, sodium oleate, sodium laurate, potassium stearate and calcium oleate.

In the toner particle production process of the present invention, the toner particles can concretely be produced by a production process as shown below.

That is, a release agent comprising the low-softening substance, the colorant, the charge control agent, the polymerization initiator and other additives are added in the polymerizable monomer and are uniformly dissolved or dispersed by means of, e.g., a homogenizer or a ultrasonic dispersion machine to prepare a monomer composition, which is then dispersed in an aqueous phase containing the dispersion stabilizer by means of a conventional stirrer or, e.g., CLEARMIX, a homomixer or a homogenizer. Granulation may preferably be carried out controlling the agitation speed and time so that droplets of the monomer composition can have the desired toner particle size. After the granulation, agitation may be carried out to such an extent that the state of particles is maintained and the particles can be prevented from settling by the action of the dispersion stabilizer. The polymerization may be carried out at a polymerization temperature set at 40° C. or above, usually from 50 to 90° C. In the latter half of the polymerization, the temperature may be raised, and also the aqueous medium may be removed in part from the reaction system in the latter half of the polymerization reaction or after the reaction has been completed, in order to remove unreacted polymerizable monomers, by-products and so forth which may cause a smell at the time of toner fixing. After the polymerization reaction has been completed, the toner particles formed are collected by washing and filtration, followed by drying by the drying method in the present invention. In the suspension polymerization, water may usually be used as the dispersion medium preferably in an amount of from 300 to 3,000 parts by weight based on 100 parts by weight of the monomer composition.

In the present invention, the Tg of the toner particles thus obtained may preferably be regulated in the range of from 40 to 75° C. If it is lower than 40° C., a problem may occur in respect of storage stability of toners and running stability of developers. If on the other hand it is higher than 75° C., a fixing point may be raised, and hence, especially in the case of full-color toners, color mixture of respective color toners may be so insufficient as to make color reproducibility poor and also to greatly lower the transparency of OHP images, thus such Tg is not preferable in view of high image quality.

The values of physical properties which are used in the present invention are measured in the manner described below.

1. Measurement of Tg of Toner Particles

In the present invention, the Tg is measured with a differential thermal analyzer (a differential scanning calorimeter, DSC) DSC-7 (manufactured by Perkin Elmer Co.) and in the following way. First, a measuring sample is precisely weighed in an amount of from 5 to 20 mg, preferably 10 mg. Then, the sample is put in an aluminum pan and an empty aluminum pan is set as a reference, to make a measurement at a rate of heating of 10° C./min within the measuring temperature range of from 30 to 200° C. As a result, the point at which the line at a middle point of base lines before and after appearance of the main-peak endothermic peak in the range of temperature of from 40 to 100° C. in the course of this heating and the differential thermal curve intersect each other is regarded as the glass transition point Tg in the present invention.

2. Measurement of Water Content

The water content of the toner particles in the present invention is determined by measuring weight loss on heating at 105° C. using an electronic moisture meter MA40 (manufactured by Zartorius Co.).

3. Measurement of Residue of Polymerizable Monomer and Organic Solvent Remaining in Toner Particles To determine the residue of the polymerizable monomer and organic solvent remaining in the toner particles, a solution prepared by dissolving 0.3 g of toner in 10 g of acetone is used. After placing the solution in an ultrasonic shaker for 30 minutes, the solution is left standing for a day. Next, the solution is filtered with a 0.5 μm filter. Each residue is measured by gas chromatography (GC) by the absolute calibration curve method under conditions as shown below.

GC Conditions

Measuring Apparatus

HEWLETT PACKARD HP6890-series capillary column (25 m×0.2 mm, HP-INNOWAX, layer thickness: 0.4 μm)
Detector: FID, He flow rate: 25 ml/min)
Injection temperature: 200° C.
Detector temperature: 200° C.

Column Temperature

Heated for 15 minutes at a rate of 10° C./min from 50° C.
Amount of sample injected: 2 μl

4. Measurement of Particle Size Distribution of Toner Particles

Particle size distribution can be measured by various methods. In the present invention, it is measured with COULTER Counter.

COULTER Counter Model TA-II or COULTER MULTISIZER (manufactured by Coulter Electronics, Inc.) is used as a measuring apparatus. As an electrolytic solution, an aqueous about 1% NaCl solution is prepared using first-grade sodium chloride. For Example, ISOTON R-II (available from Coulter Scientific Japan Co.) may be used. Measurement is made by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes on an ultrasonic dispersion machine. The volume distribution and number distribution are calculated by measuring the volume and number of toner particles by means of the above measuring apparatus, using an aperture of 100 $\mu$m as its aperture. Then the weight-based, weight-average particle diameter (D4: the middle value of each channel is used as the representative value for each channel) is determined from volume distribution.

EXAMPLES

The present invention will be described below in greater detail by giving Examples.

Example 1

In 710 parts by weight of ion-exchanged water, 450 parts by weight of an aqueous 0.1 mol/lit $Na_3PO_4$ solution was introduced, and the mixture was heated to 60° C., followed by stirring at 3,500 revolutions/minute (r.p.m.) using CLEARMIX (manufactured by M. Technique). Then, 68 parts by weight of an aqueous 1.0 mol/lit mol/lit CaCl2 solution was added thereto, obtaining an aqueous medium containing $Ca_3(PO_4)_2$.

Meanwhile, as a disperse phase, the following was prepared.

| | (by weight) |
|---|---|
| Styrene monomer | 165 parts |
| n-Butyl acrylate | 35 parts |
| C.I. Pigment Blue 15:3 | 10 parts |
| Saturated polyester | 20 parts |
| Salicylic acid metal compound | 3 parts |
| Ester wax | 25 parts |

Of the above formulation, the C.I. Pigment Blue 15:3, the salicylic acid metal compound and 100 parts by weight of the styrene monomer were dispersed for 3 hours by means of an attritor (manufactured by Mitsui Miike Engineering Corporation), obtaining a colorant dispersion. Next, to the colorant dispersion, the remaining materials of the above formulation were all added, and these were heated to 60° C. to dissolve and mix them for 30 minutes. To the resultant mixture, 10 parts by weight of a polymerization initiator 2,2'-azobis(2,4-dimethylvaleronitrile) was dissolved. Thus, a polymerizable monomer composition was prepared.

The polymerizable monomer composition was introduced into the above aqueous medium to carry out granulation for 15 minutes while maintaining the number of revolutions. Thereafter, the high-speed stirrer was changed to a stirrer having propeller stirring blades, the internal temperature was raised to 80° C., and the polymerization was continued for 10 hours at 50 r.p.m. Then, distillation was carried out for 4 hours under the conditions of an internal temperature of 80° C. and an in-system pressure of 47.3 kPa. After the distillation was completed, the slurry formed was cooled, and dilute hydrofluoric acid was added to dissolve $Ca_3(PO_4)_2$, followed by filtration, washing with water and then disintegration to obtain wet colored polymer particles (toner particles) having a water content of 15% and a weight-average particle diameter of 7.8 $\mu$m.

At this stage, the polymerizable monomers remaining unreacted in the toner particles were in the amount of 850 ppm.

The wet colored polymer particles thus obtained were treated, as preliminary heat treatment, by means of an air stream heat treatment apparatus whose air stream heat treatment section is embodied in the same manner as shown in FIG. 1 and has a piping diameter of 0.1016 m. Thereafter, the volatile components were removed by means of the vacuum heat treatment system embodied as shown in FIG. 2, having an operating capacity of 100 liters.

The air stream heat treatment as preliminary heat treatment was made under the conditions of hot-air-stream temperature: 80° C.; air feed rate: 480 $m^3$/hr; and toner particle feed rate: 70 kg/hr. After the treatment, the water content was 0.22%, and the unreacted polymerizable monomers were in the amount of 840 ppm. Also, at this stage the glass transition temperature Tg of the toner particles was measured and found to be 62° C.

The vacuum heat treatment was made under the conditions of heating temperature: 45° C.; degree of vacuum at the time of treatment: 3 kPa; and charge weight: 30 kg. High-humidity air having a temperature of 45° C., an enthalpy of about 14,000 kJ/kg (dry air) and a water content of about 90% was so introduced as to be in a feed flow rate of 0.13 $m^3$/hr·kg (toner particles).

At the time the vacuum heat treatment was started, the material temperature of toner particles was 22° C.

The vacuum heat treatment was made under the above conditions for 3 hours.

At the time the treatment was completed, the water content of toner particles was 0.20%, and the unreacted polymerizable monomers were in the amount of 45 ppm. Also, toner particles discharged after treatment were in a 90% yield based on the amount charged at the time of the vacuum heat treatment.

To 100 parts by weight of the toner particles thus obtained, 1.5 parts by weight of hydrophobic silica having a specific surface area of 200 $m^2$/g as measured by the BET method was externally added to produce a developer.

Using this developer in a remodeled machine of a color printer "COLOR LASER SHOT 2030" manufactured by CANON INC., image reproduction was tested in an environment of 23° C./65%RH. As a result, even in running or (extensive printing) on 10,000 sheets, no change was seen in image density between images at the initial stage and after the running, and images having no blank areas and having a high image quality were obtained. Also, on the organic semiconductor photosensitive member, any problems such as toner melt-adhesion and memory ghost did not occur. Images were further formed by double-side printing, where any offset was not seen to have occurred on both sides of transfer materials. Also, images were formed on OHP sheets, where transparent good images were obtained.

An image reproduction was also tested in the same manner in an environment of 30° C./80%RH. As a result, similarly good results were obtained.

Example 2

Toner particles obtained in the same manner as in Example 1 up to the preliminary heat treatment were treated by means of a vacuum heat treatment system embodied in the same manner as shown in FIG. 2.

The vacuum heat treatment was made under the conditions of heating temperature: 45° C.; degree of vacuum at the time of treatment: 3 kPa; and charge weight: 30 kg. High-humidity air having a temperature of 45° C., an enthalpy of about 2,500 kJ/kg (dry air) and a water content of about 60% was so introduced as to be in a feed flow rate of 0.13 $m^3$/hr·kg (toner particles).

At the time the vacuum heat treatment was started, the material temperature of toner particles was 22° C. The vacuum heat treatment was made under the above conditions for 3 hours.

At the time the treatment (drying) was completed, the unreacted polymerizable monomers were in the amount of 95 ppm. Also, the toner particles discharged after treatment were in a 89% yield.

To the toner particles thus obtained, the same hydrophobic silica as that used in Example 1 was also externally added in the same way to produce a developer, and image reproduction was also tested in the same manner as in Example 1. As a result, in the image reproduction tested in the environment of 30° C./80%RH, solid-image blank areas caused by poor transfer slightly occurred on about the 9,500th sheet and following sheets.

Example 3

Toner particles obtained in the same manner as in Example 1 up to the preliminary heat treatment were treated by means of a vacuum heat treatment system embodied in the same manner as that shown in FIG. 2.

The vacuum heat treatment was made under conditions of heating temperature: 45° C.; degree of vacuum at the time of treatment: 3 kPa; and charge weight: 30 kg. Superheated steam having a temperature of 45° C. and a vapor pressure of 3 kPa was so introduced as to be in a steam feed flow rate of 0.13 $m^3$/hr·kg (toner particles).

At the time the vacuum heat treatment was started, the material temperature of toner particles was 22° C. The vacuum heat treatment was made under the above conditions for 3 hours.

At the time the drying was completed, the unreacted polymerizable monomers were in the amount of 25 ppm. Also, the toner particles discharged after treatment were in a 90% yield.

To the toner particles thus obtained, the same hydrophobic silica as that used in Example 1 was also externally added in the same way to produce a developer, and image reproduction was also tested in the same manner as in Example 1. As the result, good results were obtained like those in Example 1.

Example 4

Toner particles obtained in the same manner as in Example 1 up to the preliminary heat treatment were treated by means of a vacuum heat treatment apparatus embodied in the same manner as that shown in FIG. 3, having an operating capacity of 100 liters. The vacuum heat treatment was made for 3 hours under the same conditions as those in Example 3.

At the time the vacuum heat treatment was started, the material temperature of toner particles was 22° C.

At the time the drying was completed, the unreacted polymerizable monomers were in the amount of 40 ppm. Also, the toner particles discharged after treatment were in a 70% yield.

To the toner particles thus obtained, the same hydrophobic silica as that used in Example 1 was also externally added in the same way to produce a developer, and image reproduction was also tested in the same manner as in Example 1. As a result, good results were obtained like those in Example 1.

Example 5

Toner particles obtained in the same manner as in Example 1 up to the preliminary heat treatment were treated by means of a vacuum heat treatment apparatus embodied in the same manner as that shown in FIG. 4, having an operating capacity of 100 liters. The vacuum heat treatment was made for 3 hours under the same conditions as those in Example 3.

At the time the vacuum heat treatment was started, the material temperature of toner particles was 22° C.

At the time the drying was completed, the unreacted polymerizable monomers were in the amount of 25 ppm. Also, the toner particles discharged after treatment were in a 83% yield.

To the toner particles thus obtained, the same hydrophobic silica as that used in Example 1 was also externally added in the same way to produce a developer, and image reproduction was also tested in the same manner as in Example 1. As the result, good results were obtained like those in Example 1.

Example 6

Vacuum heat treatment was made by means of the same apparatus and under the same heat treatment conditions as those in Example 3 except for using a disintegrated product comprised of toner particles having a water content of 2.8% after the preliminary heat treatment.

At the time the vacuum heat treatment was started, the material temperature of toner particles was 20° C. At the time the drying was completed, the unreacted polymerizable monomers were in the amount of 50 ppm. Also, the toner particles discharged after treatment were in a 88% yield.

To the toner particles thus obtained, the same hydrophobic silica as that used in Example 1 was also externally added in the same way to produce a developer, and image reproduction was also tested in the same manner as in Example 1. As the result, good results of image reproduction were obtained like those in Example 1.

Example 7

Toner particles obtained in the same manner as in Example 1 up to the step of disintegration were treated, as preliminary heat treatment, by means of the same heat treatment system and under the same conditions as those in Example 3. The toner particles having a water content of 0.22%, containing residual unreacted polymerizable monomers in the amount of 840 ppm, having a toner particle glass transition temperature Tg of 62° C. and having a particle temperature of 40° C. immediately after the treatment were treated while maintaining that temperature, by means of the same vacuum heat treatment apparatus and under the same conditions as those in Example 3 for 3 hours.

At the time the vacuum heat treatment was completed, the unreacted polymerizable monomers were in the amount less than 20 ppm, which was the measurement limit. The toner particles discharged after treatment were in a 91% yield.

To the toner particles thus obtained, the same hydrophobic silica as that used in Example 1 was also externally added to produce a developer, and image reproduction was also tested in the same manner as in Example 1. As a result, good results were obtained like those in Example 1.

Example 8

Toner particles obtained in the same manner as in Example 1 up to the preliminary heat treatment were treated by means of a vacuum heat treatment system embodied in the same manner as that shown in FIG. 2.

The vacuum heat treatment was made under the conditions of heating temperature: 45° C.; degree of vacuum at the time of treatment: 3 kPa; and feed: 30 kg. Superheated steam having a temperature of 45° C. and a vapor pressure of 3 kPa was so introduced as to be in a steam feed flow rate of 0.029 $m^3$/hr·kg (toner particles).

At the time the vacuum heat treatment was started, the material temperature of toner particles was 22° C. The vacuum heat treatment was made under the above conditions for 3 hours.

At the time the drying was completed, the unreacted polymerizable monomers were in the amount of 75 ppm. Also, the toner particles discharged after treatment were in a 93% yield.

To the toner particles thus obtained, the same hydrophobic silica as that used in Example 1 was also externally added in the same way to produce a developer, and image reproduction was also tested in the same manner as in Example 1. As a result, good results were obtained like those in Example 1.

Comparative Example 1

Using the toner particles having been subjected to preliminary heat treatment in Example 1, having a water content of 0.22% and containing residual unreacted polymerizable monomers in the amount of 840 ppm, a developer was produced by blending 1.5 parts by weight of the hydrophobic silica as used in Example 1 with 100 parts by weight of the toner particles, and image reproduction was also tested in the same manner as in Example 1. As a result, solid-image blank areas caused by poor transfer occurred on about the 500th sheet and following sheets, and a decrease in image density was seen on about the 700th sheet and following sheets. Also, in the image reproduction tested in an environment of 30° C./80%RH, faulty images due to the melt-adhesion of toner to the photosensitive member appeared on about the 1,000th sheet.

Comparative Example 2

Treatment was made using the same toner particles as those of Example 1 by means of the same preliminary heat treatment apparatus and vacuum heat treatment apparatus and under the same conditions as those in Example 3, except that low-humidity air obtained by heating air of 30° C. and 80%RH under reduced pressure and to 45° C. to have an enthalpy of about 100 kJ/kg (dry air) and a water content of about 5% was introduced into the vacuum heat treatment apparatus.

At the time the vacuum heat treatment was started, the material temperature of toner particles was 22° C.

At the time the heat treatment was completed, the unreacted polymerizable monomers were in the amount of 250 ppm. The toner particles discharged after treatment were in a 90% yield. Also, a vacuum pump having a larger capacity than the vacuum pump used in Example 3 was necessary in order to keep the same degree of vacuum as that in Example 3.

To the toner particles thus obtained, the same hydrophobic silica as that used in Example 1 was externally added to produce a developer, and image reproduction was also tested in the same manner as in Example 1. As a result, solid-image blank areas caused by poor transfer occurred on about the 2,500th sheet and following sheets, and a decrease in image density was seen on about the 3,000th sheet and following sheets.

Comparative Example 3

Treatment was made using the same toner particles (Tg: 62° C.) as those of Example 1 by means of the same preliminary heat treatment apparatus and vacuum heat treatment apparatus and under the same conditions as those in Example 3, except that superheated steam with a temperature of 70° C. and a vapor pressure of 3 kPa was introduced into the vacuum heat treatment apparatus.

At the time the vacuum heat treatment was started, the material temperature of toner particles was 22° C.

After the drying was completed, the toner particles were unloaded after treatment, where mutual hard agglomeration of toner particles was greatly seen. Also, the melt-adhesion of particles was seen on the wall surface in the apparatus. Hence, toner particles discharged after treatment were in a 80% yield, and the evaluation made in Example 1 as toner particles was impossible.

Example 9

Treatment was made using the same toner particles as those of Example 1 by means of the same preliminary heat treatment apparatus and vacuum heat treatment apparatus and under the same conditions as those in Example 3, except that the feed flow rate of the superheated steam was changed to 0.50 $m^3$/hr·kg (toner particles), the degree of vacuum at the time of treatment to 5 kPa, and the vapor pressure of the superheated steam to be fed to 5 kPa.

At the time the vacuum heat treatment was started, the material temperature of toner particles was 22° C.

At the time the treatment was completed, the water content of toner particles was 0.3%, and the unreacted polymerizable monomers were in the amount of 90 ppm. Also, the toner particles discharged after treatment were in a 85% yield.

To the toner particles thus obtained, the same hydrophobic silica as that used in Example 1 was also externally added to produce a developer, and image reproduction was also tested in the same manner as in Example 1. As a result, in the image reproduction tested in the environment of 30° C./80%RH, solid-image blank areas caused by poor transfer slightly occurred on about the 9,000th sheet.

Example 10

Treatment was made using the same toner particles as those of Example 1 by means of the same preliminary heat treatment apparatus and vacuum heat treatment apparatus and under the same conditions as those in Example 3, except that the feed flow rate of the superheated steam was changed to 0.01 $m^3$/hr·kg (toner particles).

At the time the vacuum heat treatment was started, the material temperature of toner particles was 22° C.

At the time the vacuum heat treatment was completed, the unreacted polymerizable monomers were in the amount of 100 ppm. Also, the toner particles discharged after treatment were in a 94% yield.

To the toner particles thus obtained, the same hydrophobic silica as that used in Example 1 was also externally added to produce a developer, and image reproduction was also tested in the same manner as in Example 1. As a result, in the image reproduction tested in the environment of 30° C./80%RH, solid-image blank areas caused by poor transfer slightly occurred on about the 8,000th sheet.

Example 11

Treatment was made using the same toner particles as those of Example 1 by means of the same preliminary heat treatment apparatus and vacuum heat treatment apparatus and under the same conditions as those in Example 3, except that the degree of vacuum at the time of treatment was changed to 4.2 kPa and saturated steam having a temperature of about 30° C. was introduced into the vacuum heat treatment apparatus. Also, at the time the vacuum heat treatment was started, the material temperature of toner particles was 22° C.

At the time the treatment was completed, the water content of toner particles was 0.5%, and the unreacted polymerizable monomers were in the amount of 95 ppm. Also, the toner particles discharged after treatment were in a 88% yield.

To the toner particles thus obtained, the same hydrophobic silica as that used in Example 1 was also externally added to produce a developer, and image reproduction was also tested in the same manner as in Example 1. As a result, in the image reproduction tested in the environment of 30° C./80%RH, solid-image blank areas caused by poor transfer slightly occurred on about the 8,500th sheet.

The vacuum heat treatment made in the foregoing Examples and Comparative Examples and the results thereof are shown in Table 1. In the image reproduction test, evaluation was made on whether or not any of solid-image blank areas, decrease in image density and melt-adhesion of toner to photosensitive member occurred, and the results were evaluated according to the following criteria, in respect of the number of copied sheets at the time any of the above problems occurred.

A: No problem occurs even on 10,000 sheets.
B: Any problem occurs on 8,000th to 10,000th sheet.
C: Any problem occurs on 4,000th to 8,000th sheet.
D: Any problem occurs on 2,000th to 4,000th sheet.
E: Any problem occurs on 2,000th or less sheet.

TABLE 1

| Example | | | | | | | | | | | Comparative Example | | |
|---|---|---|---|---|---|---|---|---|---|---|---|---|---|
| 1 | 2 | 3 | 4 | 5 | 6 | 7 | 8 | 9 | 10 | 11 | 1 | 2 | 3 |
| Vacuum heat treatment system: | | | | | | | | | | | | | |
| FIG. 2 | FIG. 2 | FIG. 2 | FIG. 3 | FIG. 4 | FIG. 2 | FIG. 2 | FIG. 2 | FIG. 2 | FIG. 2 | FIG. 2 | none | FIG. 2 | FIG. 2 |
| Preliminary heat treatment: | | | | | | | | | | | | | |
| yes | yes | yes | yes | yes | yes | yes | yes | yes | yes | yes | yes | yes | yes |
| Water content before drying: (%) | | | | | | | | | | | | | |
| 0.22 | 0.22 | 0.22 | 0.22 | 0.22 | 3 | 0.22 | 0.22 | 0.22 | 0.22 | 0.22 | — | 0.22 | 0.22 |
| Amount of unreacted polymerizable monomer before drying: (ppm) | | | | | | | | | | | | | |
| 840 | 840 | 840 | 840 | 840 | 840 | 840 | 840 | 840 | 840 | 840 | — | 840 | 840 |
| Heating temperature: (° C.) | | | | | | | | | | | | | |
| 45 | 45 | 45 | 45 | 45 | 45 | 45 | 45 | 45 | 45 | 45 | — | 45 | 45 |
| Degree of vacuum: (kPa) | | | | | | | | | | | | | |
| 3 | 3 | 3 | 3 | 3 | 3 | 3 | 3 | 5 | 3 | 4.2 | — | 3 | 3 |
| Type of steam: | | | | | | | | | | | | | |
| HHA | HHA | SHS | SHS | SHS | SHS | SHS | SHS | SHS | SHS | STS | — | LHA | SHS |
| Steam temperature: (° C.) | | | | | | | | | | | | | |
| 45 | 45 | 45 | 45 | 45 | 45 | 45 | 45 | 45 | 45 | 30 | — | 45 | 70 |
| High/low-humidity air enthalpy: kJ/kg (dry air) | | | | | | | | | | | | | |
| ≈14,000 | ≈2,500 | — | — | — | — | — | — | — | — | — | — | ≈100 | — |
| Steam feed flow rate: ($m^3$/hr · kg) | | | | | | | | | | | | | |
| 0.13 | 0.13 | 0.13 | 0.13 | 0.13 | 0.13 | 0.13 | 0.029 | 0.5 | 0.01 | 0.13 | — | 0.13 | 0.13 |
| Toner particle material temperature before treatment: (° C.) | | | | | | | | | | | | | |
| 22 | 22 | 22 | 22 | 22 | 20 | 40 | 22 | 22 | 22 | 22 | — | 22 | 22 |
| Amount of residual polymerizable monomer: (ppm) | | | | | | | | | | | | | |
| 45 | 95 | 25 | 40 | 25 | 50 | >20 | 75 | 90*1 | 100 | 95*2 | 840 | 250 | — |
| Yield after discharge: (%) | | | | | | | | | | | | | |
| 90 | 89 | 90 | 70 | 83 | 88 | 91 | 93 | 85 | 94 | 88 | — | 90 | 80 |
| Image evaluation: | | | | | | | | | | | | | |
| A | B | A | A | A | A | A | A | B | B | B | E | D | (X) |

HHA: High-humidity air, SHS: Superheated steam, STS: Saturated steam, LHA: Low-humidity air
*1: with water content of 0.3%, *2: with water content of 0.5%
(X): Evaluation impossible

What is claimed is:

1. A process for producing toner particles comprising:

polymerizing in an aqueous dispersion medium a polymerizable monomer composition containing at least a polymerizable monomer and a colorant, to form colored polymer particles, followed by washing and then dehydration to obtain toner particles;

feeding the toner particles into an evacuatable and heatable container to carry out vacuum heat treatment; and conducting the vacuum heat treatment for the toner particles while introducing into the container an injection medium having a temperature lower than glass transition temperature Tg of the toner particles and selected from the group consisting of i) saturated steam, ii) superheated steam and iii) high-humidity air having an enthalpy of 2,500 kJ/kg (dry air) or higher, said injection medium being fed at a flow rate of from 0.01 $m^3$/hr·kg (toner particles) to 0.5 $m^3$/hr·kg (toner particles).

2. The process according to claim 1, wherein said high-humidity air has a water content of 50% or more.

3. The process according to claim 1, wherein said high-humidity air has a water content of 60% or more.

4. The process according to claim 1, wherein said high-humidity air has an enthalpy of 6,500 kJ/kg (dry air) or higher.

5. The process according to claim 1, wherein said high-humidity air has a water content of 50% or more and an enthalpy of 6,500 kJ/kg (dry air) or higher.

6. The process according to claim 1, wherein said high-humidity air has a water content of 60% or more and an enthalpy of 6,500 kJ/kg (dry air) or higher.

7. The process according to claim 1, wherein said high-humidity air has a water content of 80% or more and an enthalpy of 6,500 kJ/kg (dry air) or higher.

8. The process according to claim 1, wherein said injection medium is fed at a flow rate from 0.04 $m^3$/hr·kg (toner particles) to 0.27 $m^3$/hr·kg (toner particles).

9. The process according to claim 1, wherein said vacuum heat treatment is the step of removing a volatile component remaining in the toner particles.

10. The process according to claim 9, wherein said volatile component contains at least an unreacted polymerizable monomer.

11. The process according to claim 1, wherein said toner particles fed for the vacuum heat treatment have a water content of 3.0% or less.

12. The process according to claim 1, wherein said toner particles fed for the vacuum heat treatment have a water content of 1.0% or less.

13. The process according to claim 1, wherein preliminary heat treatment is made before the vacuum heat treatment to remove the aqueous dispersion medium.

14. The process according to claim 13, wherein said preliminary heat treatment is the step of heat-treating wet colored polymer particles while dispersing the particles in high-velocity hot-air streams and simultaneously forwarding the particles in parallel flow with respect to those streams.

15. The process according to claim 13, wherein in said preliminary heat treatment, after or at the same time the aqueous dispersion medium has been removed, said colored polymer particles are made to have a material temperature of from 30° C. to 60° C., and are subjected to the vacuum heat treatment as the particles are maintained at that temperature.

* * * * *